US005721557A

United States Patent [19]

Wheeler et al.

[11] Patent Number: 5,721,557

[45] Date of Patent: Feb. 24, 1998

[54] NON-SQUINTING END-FED QUADRIFILAR HELICAL ANTENNA

[75] Inventors: Myron S. Wheeler, Columbia; Daniel Davis, Baltimore; Timothy G. Waterman, Eldersburg, all of Md.

[73] Assignee: Westinghouse Electric Corporation, Pittsburgh, Pa.

[21] Appl. No.: 639,338

[22] Filed: Apr. 26, 1996

Related U.S. Application Data

[63] Continuation of Ser. No. 297,192, Aug. 26, 1994, abandoned.

[51] Int. Cl.[6] ..... H01Q 1/36

[52] U.S. Cl. ..... 343/895; 343/749

[58] Field of Search ..... 343/722, 749, 343/752, 850, 890, 891, 895

[56] References Cited

U.S. PATENT DOCUMENTS

| | | | |
|---|---|---|---|
| 2,712,602 | 7/1955 | Hallen | 343/895 |
| 2,985,878 | 3/1961 | Krause et al. | 343/895 |
| 3,427,624 | 2/1969 | Wanselow et al. | 343/895 X |
| 3,568,205 | 3/1971 | Buxton et al. | 343/749 |
| 3,573,840 | 4/1971 | Gouilliou et al. | 343/895 |
| 3,946,397 | 3/1976 | Irwin | 343/788 |
| 4,011,567 | 3/1977 | Ben-Dov | 343/895 X |
| 4,092,646 | 5/1978 | Newington | 343/749 |
| 4,238,800 | 12/1980 | Newington | 343/749 X |
| 4,554,554 | 11/1985 | Olesen et al. | 343/895 |
| 5,032,950 | 7/1991 | Lavene | 361/306 |
| 5,371,650 | 12/1994 | Lavene | 361/310 |

FOREIGN PATENT DOCUMENTS

| | | | |
|---|---|---|---|
| 0593647 | 3/1960 | Canada | 343/895 |
| 0520564 | 12/1992 | European Pat. Off. | H01Q 11/08 |
| 1083265 | 3/1984 | U.S.S.R. | 343/895 |
| 980873 | 1/1965 | United Kingdom . | |
| 9417565 | 8/1994 | WIPO | H01Q 1/36 |

OTHER PUBLICATIONS

Ellioh et al, "IEEE Standard Definitions of Terms for Antennas", 1983, p27.

IEEE Transactions on Antennas and Propagation vol. 16 No. 4 Jul. 1968 pp. 491–493.

*Primary Examiner*—Donald T. Hajec
*Assistant Examiner*—Tan Ho
*Attorney, Agent, or Firm*—R. P. Lenart

[57] ABSTRACT

A nonsquinting end-fed quadrifilar helical antenna is provided. Each conductor of the antenna is fed with a successively delayed phase representation of the input signal to optimize transmission characteristics. Each of the conductors is separated into a number Z of discrete conductor portions by Z-1 capacitive discontinuities. The addition of the capacitive discontinuities results in the formation of an antenna array. The end result of the antenna array is a quadrifilar helical antenna which is nonsquinting (radiates in a given direction independently of frequency).

17 Claims, 8 Drawing Sheets

FIG. 1
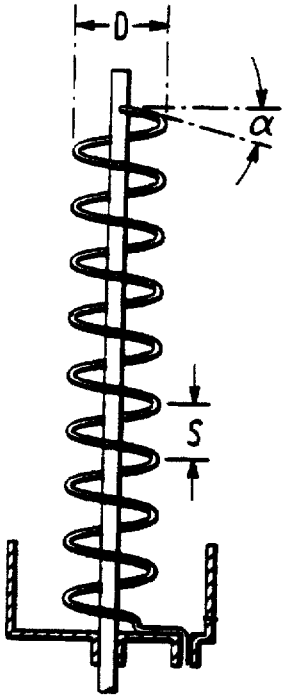
PRIOR ART
FIG. 3
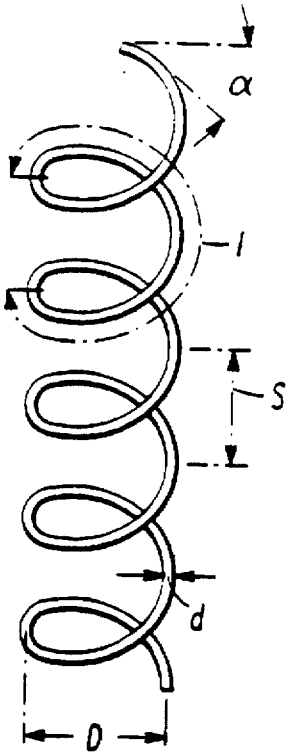
PRIOR ART
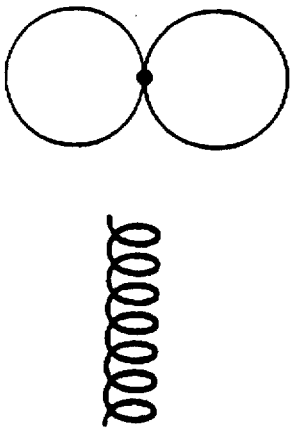
FIG.2a
PRIOR ART
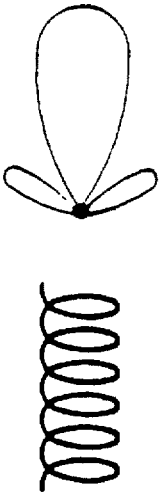
FIG.2b
PRIOR ART
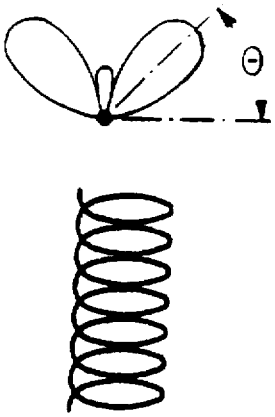
FIG.2c
PRIOR ART

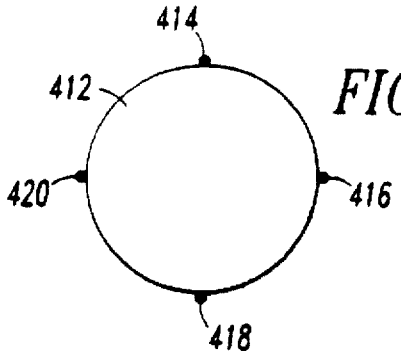
FIG. 4a
FIG. 4b
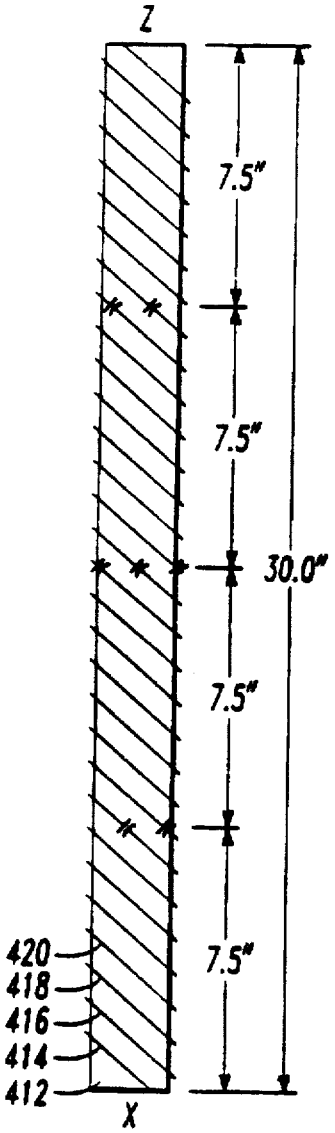
FIG. 4c
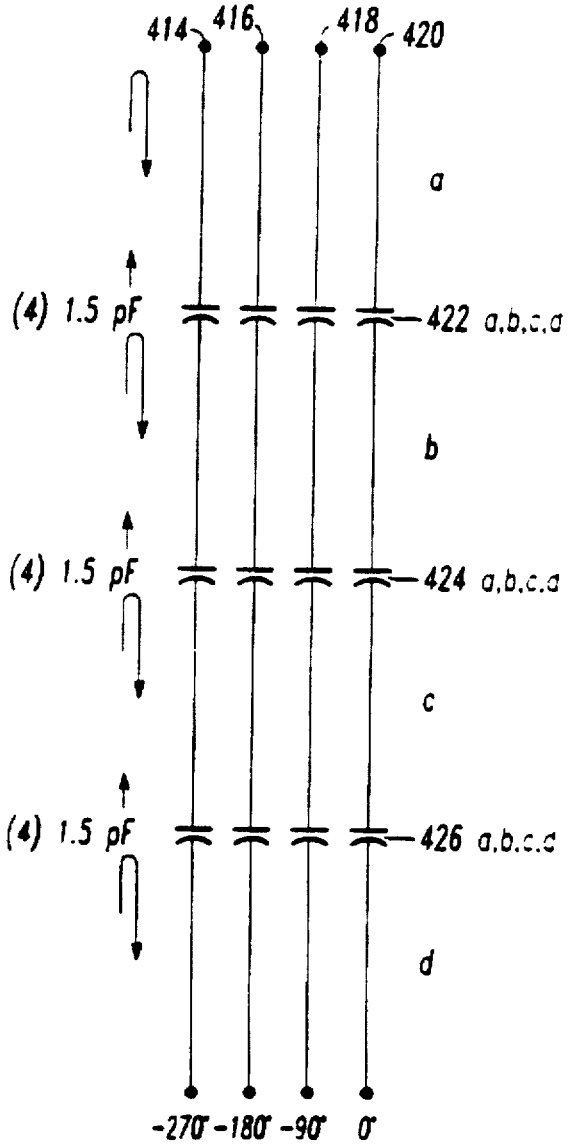

PATTERN OF THE NON-SQUINTING L-BAN ANTENNA AT 1545 MHz.
PATTERN IS SCANNED AT 15° ABOVE THE HORIZON

PATTERN OF THE NON-SQUINTING L-BAN ANTENNA AT 1660 MHz.
PATTERN IS SCANNED AT 15° ABOVE THE HORIZON

FIG. 7
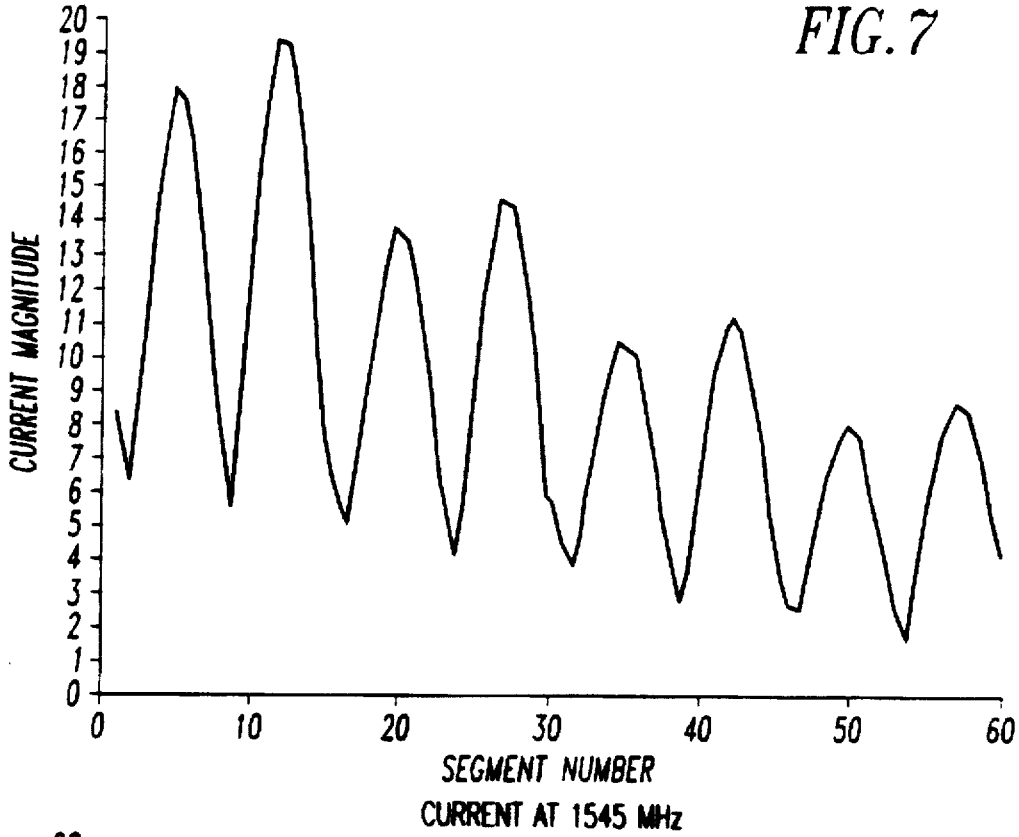
CURRENT AT 1545 MHz
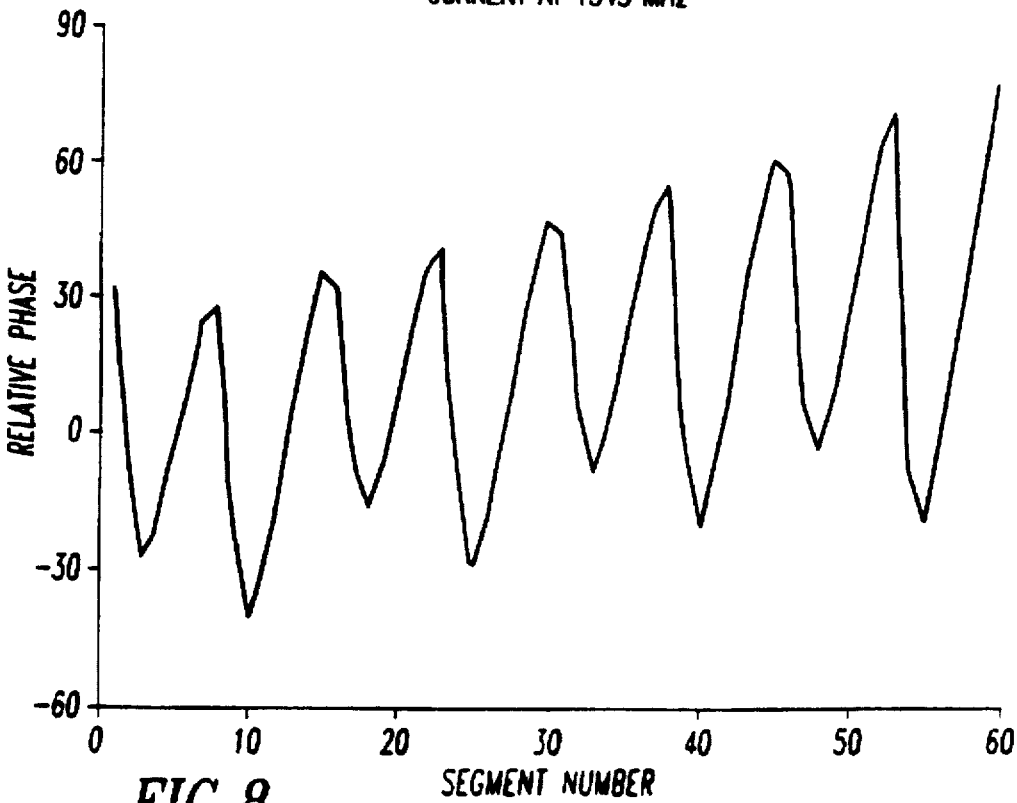
FIG. 8
PHASE OF CURRENT AT 1545 MHz

NON-SQUINTING END-FED QUADRIFILAR HELICAL ANTENNA

This application is a continuation of application Ser. No. 08/297,192 filed Aug. 26, 1994 now abandoned.

BACKGROUND OF THE INVENTION (1) Field of the Invention

The present invention relates to helical antennas. More particularly the invention pertains to end-fed nonsquinting quadrifilar helical antennas. This application is related to U.S. Pat. No. 5,489,916, which is hereby incorporated by reference.

(2) Description of the Related Art

In general helical antennas are widely known. They typically comprise single or multiple conductors wound around a mast into a helical shape. Each conductor has a feed and a far end, with one end designated as a feed end to accept antenna input. The far end may be left as an open circuit, or in the case of multiple conductors (multifilar) the far ends may be connected (short circuited) together.

When the diameter of a helical antenna is small in comparison to the wavelength of the signal to be transmitted, the transmitted wave radiates in a radial mode in an omnidirectional pattern (when the phase on the helices is set to do so). Energy travels with negligible radiation from the feed end the length of the helix to the far end, is reflected from either a short or open circuit and radiates on return toward the feed end. The radial mode antenna is most readily used as a backfire device, meaning the omnidirectional pattern tends to be directed toward the end that radiates first. However, by adjusting the pitch of the helices, the beam may be scanned through wide angles all the way from the normal to endfire (away from the feed end in the instant invention) direction.

The pointing angle of the radiation pattern of an end-fed antenna changes with frequency (squints) with the higher (and lower) frequencies radiating away from the feed end at an angle of $\Delta\theta$ (radians) from the midband frequency F, where $$\Delta\theta=\Delta F/F \quad (1)$$

with $\Delta F$ equal to the difference in Hertz between the midband frequency F and the higher (or lower) frequency.

This squint with frequency is undesirable as it tends to result in beams pointing in different directions (one for transmit, one for receive) when a helical antenna is used in a fully duplexed wideband communication system.

SUMMARY OF THE INVENTION

Accordingly, it is a general purpose and object of the present invention to provide an improved quadrifilar helical antenna. It is a further object that the quadrifilar helical antenna provide specific radiation patterns within specific frequency ranges.

The features and advantages of the present invention include even power distribution along the entire length of the antenna resulting in increased power output for a given input, beampointing independent of the frequency to be transmitted, a narrower beam with higher gain allowing more energy to be transmitted in the direction of its intended receiver resulting in more efficient power transmission, and allowing the same antenna to exhibit optimum gain characteristics on a (different) receiving frequency without retuning or adjustment when switching between transmit and receive modes.

These objects of the present invention are accomplished by providing an end-fed quadrifilar helical antenna. Each conductor of the antenna is fed with a successively delayed phase representation of the input signal to optimize transmission characteristics. Each of the conductors is separated into a number Z of discrete conductor portions by Z-1 capacitive discontinuities. The addition of the capacitive discontinuities results in the formation of an antenna array. The end result of the antenna array is a quadrifilar helical antenna which is nonsquinting and has the further features and advantages as described above.

BRIEF DESCRIPTION OF THE DRAWINGS

FIG. 1 illustrates a typical single conductor helical antenna.

FIG. 2*a* illustrates the normal radiation mode of a typical helical antenna.

FIG. 2*b* illustrates the axial radiation mode of a typical helical antenna.

FIG. 2*c* illustrates the radial radiation mode of a typical helical antenna.

FIG. 3 illustrates the geometry of a typical helical antenna.

FIG. 4*a* illustrates a top view of a quadrifilar helical antenna of the present invention.

FIG. 4*b* illustrates a side view of a quadrifilar helical antenna of the present invention.

FIG. 4*c* illustrates a representation of an unwound quadrifilar helical antenna of the present invention.

FIG. 7 illustrates a current distribution along the antenna of the present invention with an input at 1545 Mhz.

FIG. 8 illustrates the phase of the current along the length of the antenna of the present invention with an input at 1545 Mhz.

DETAILED DESCRIPTION

Figure 4D:
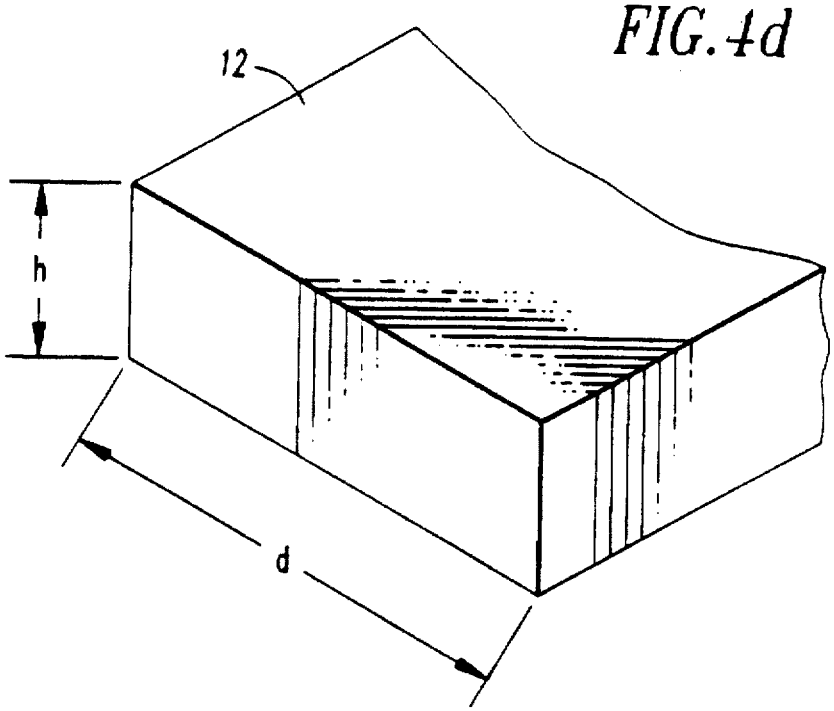
FIG. 4*d* illustrates an isometric view of a conductor of a typical helical antenna.

An antenna is usually defined as the structure associated with the region of transition between a guided wave and a free space wave, and vice versa. On transmission, an antenna accepts energy from a transmission line and radiates it into space, and on reception, an antenna gathers energy from an incident wave and transmits it down a transmission line.

FIG. 1 illustrates a typical single conductor helical antenna (helix). A helix can radiate in many modes. A helix comprises a single conductor or multiple conductors wound into a helical shape. As energy is fed into the feed end of a conductor, the conductor acts as a transmission line to conduct the energy to the far end where it is then reflected back toward the feed end. Upon initial reflection, the conductor then acts as an antenna to radiate the energy from the conductor. The amount of radiation per unit length of conductor decreases exponentially as the energy is conducted away from the reflective (far) end. In other words, most of the radiation is emitted from the far end of the antenna after reflection while very little is emitted from the near (or feed) end.

The normal mode of radiation of a helical antenna, illustrated in FIG. 2*a*, yields radiation broadside (normal) to the helix axis and occurs when the helix diameter is small with respect to transmitted wavelength. The axial mode, illustrated in FIG. 2*b*, provides maximum radiation along the helix axis and occurs when the helix circumference is of the order of one wavelength.

The radial mode, illustrated in FIG. 2*c*, results in a conical beam pattern and occurs when the circumference of the helix is much smaller than a wavelength. The angle of radiation θ of the beam pattern of a typical helical antenna is a function of the number of turns per unit length of the conductor of the helix for a given frequency.

The helical antenna parameters are illustrated in FIG. 3 and are defined as follows:

D=diameter of helix (center to center)

S=spacing between turns (center to center)

$\alpha$=pitch angle=$\tan^{-1}(S/wD)$

L=axial length of helix=NS d=diameter of helix conductor l=length of one turn=$[(\pi D)^2+S^2]^{1/2}$ Further background material may be found in *Antenna Engineering Handbook*, Second Edition, McGraw-Hill, 1984, especially chapter 13, entitled "Helical Antennas", whose subject matter is hereby incorporated by reference.

The preferred embodiment for a nonsquinting scanning helix is illustrated in FIG. 4. FIG. 4*a* illustrates a top view of the mast 412 with each of the four conductors 414, 416, 418 and 420 of the quadrifilar helix equally distributed about the mast. Additionally, each conductor is separated in phase by 90 degrees, with the first conductor 414 at 270 degrees, second conductor 416 at −180 degrees, third conductor 418 at −90 degrees and fourth conductor 420 at −0 degrees.

FIG. 4*b* illustrates a two dimensional representation of the 4 conductors 414, 416, 418, 420 used in the preferred embodiment wound around mast 412. In the preferred embodiment, the optimum frequency of the antenna is within the L band. This optimal configuration is achieved by using 4–6 inches per turn and a scan angle between 15 and 58 degrees. Other frequency ranges are achievable by those skilled in the art through minor adjustments.

FIG. 4*c* illustrates the 4 conductors 414, 416, 418, 420 in a functional manner as if they were straightened. In the preferred embodiment, capacitors 422*a–d*, 424*a–d*, 426*a–d* are placed equidistant along each conductor 414, 416, 418 and 420, effectively separating each conductor into 4 equal portions. In the preferred embodiment, the length of each portion is 7.5 inches and the values of each capacitor are equivalent at 1.5 pF. The number of conductor portions may vary from 2 to Z, where Z is a positive whole number. The number of capacitors may vary between 1 and Z-1 per conductor.

The arrows of FIG. 4*c* represent energy transmission from one conductor segment to the next, for example 414*d* to the next segment 414*c* across capacitive discontinuity 426*a*. Energy is partially transmitted and partially reflected along each segment. As capacitance is increased, more energy is applied to the following section. When a suitable value is reached, the gain is maximized and equal to that of an antenna without capacitive discontinuities, but without the squint.

The addition of capacitive discontinuities 422, 424, 426 acts to separate each of the helices into an array of helical antenna elements. As each unbroken element tends to radiate most of its energy at the end closest to the beginning (or point of reflection) of current, breaking up the conductors and the adding of capacitive discontinuities to form an array of helical antennas results in an antenna array with even power distribution. An even power distribution provides a more efficient antenna with higher gain that emits more power per unit of input power.

FIG. 4*d* illustrates an isometric view of flat conductor 12. The figure is not drawn to scale as d is much greater than h.

Figure 4E:
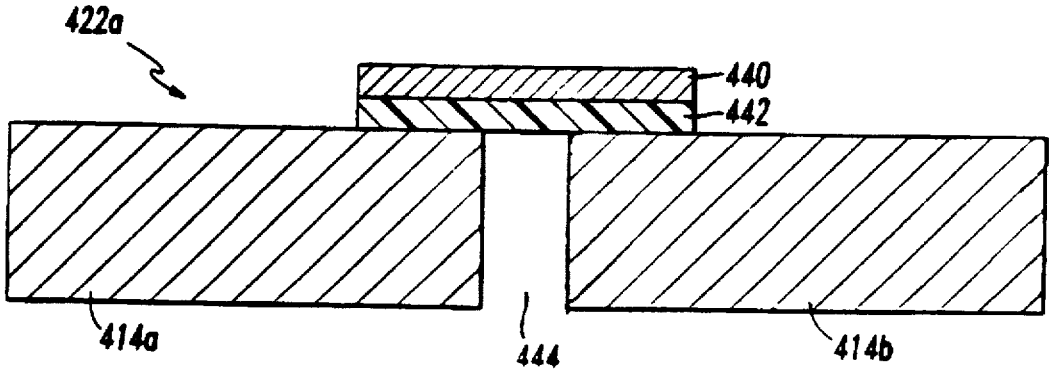
FIG. 4*e* illustrates a capacitive discontinuity between the conductive portions of a quadrifilar helical antenna of the present invention.

FIG. 4*e* illustrates the capacitive discontinuity 422*a–d* of FIG. 4*c*. Only single discontinuity 422*a* is referenced for clarity in the following explanation. In the preferred embodiment, all capacitive discontinuities at one junction are equivalent. Conductor 414 is split into at least 2 portions 414*a*, 414*b* with a gap 444 between the portions. A dielectric material 442 such as mylar or TPX is then applied as a "bridge" over top of and connected to both portions. A metallic tape 440 made from, for example, copper or other suitable material, is then used to hold the dielectric to the two portions thus resulting in a capacitive effect between the two portions.

Another embodiment of the present invention includes the helix separated into two portions by a capacitive discontinuity with the conductor fed by inputs from both ends. The spacing of the capacitive discontinuity in this example is approximately two-thirds the distance from the bottom end of the conductor.

Figure 4F:
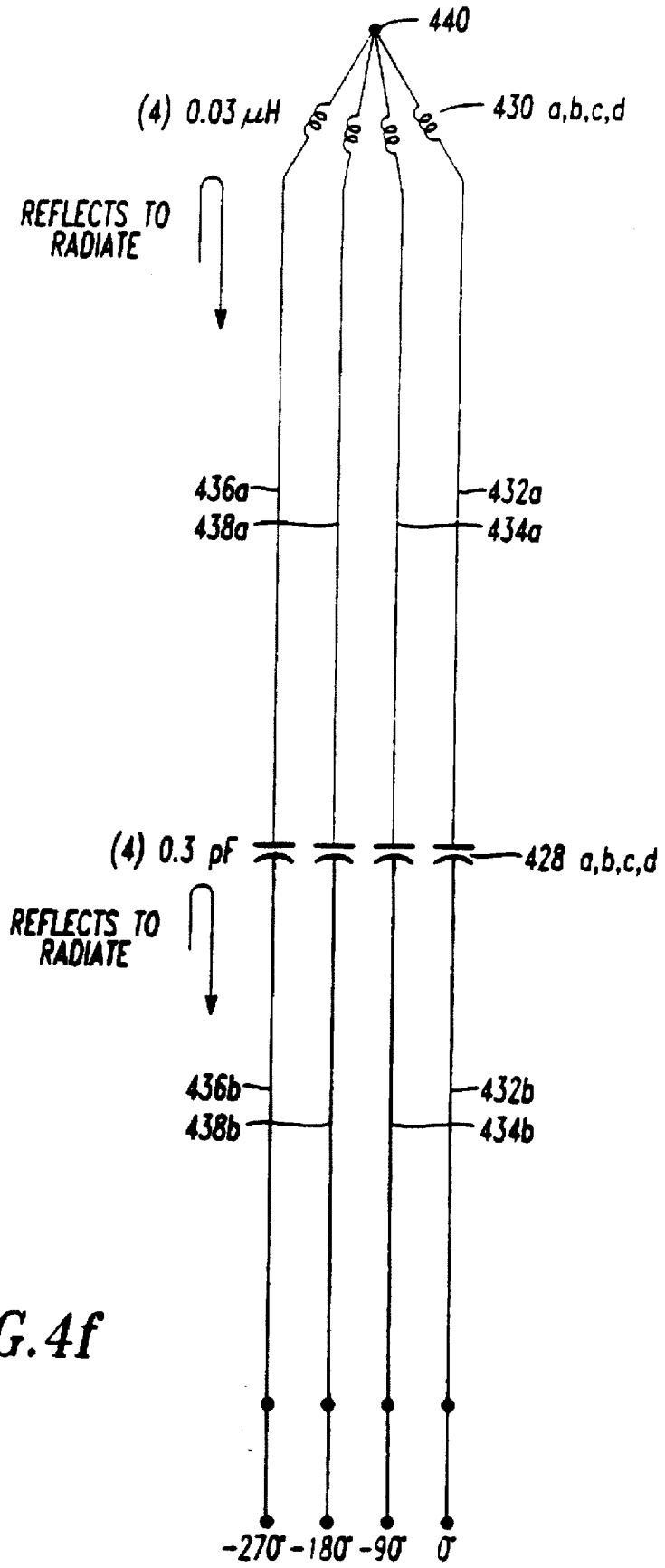
FIG. 4*f* illustrates an unwound quadrifilar helical antenna embodiment of the present invention.

FIG. 4*f* illustrates an embodiment for the situation when a quadrifilar helix is separated into two portions (Y=2 and N=4). In this embodiment of the invention, four capacitive discontinuities equal to 0.3 Pf capacitors 428*a–d* are used to separate each of the four conductors 432, 434, 436 and 438 into two equal portions. The feed end accepts the four inputs, with each successive input separated in phase by 90 degrees from the previous input. The four conductors 432, 434, 436 and 438 are connected at the far end 440 through four inductors 430*a–d*, which in this embodiment have equivalent values of 0.03 μH.

It should be pointed out that while each separate portion of the helix radiates at an equivalent power level and does squint, the overall effect for the helix array is for the pattern to be constant at a given angle θ and thus to be nonsquinting.

The angle of propagation θ for the antenna as a whole is a function of the $\sin^{-1}$ of the phase between the elements and the distance between the windings.

A helix of conductors uninterrupted by capacitive discontinuities radiates at an angle proportional to $1/\lambda$ (which is equivalent to radiating at an angle proportional to frequency), while the antenna of the present invention radiates at an angle independent of frequency (or wavelength λ) and is thus nonsquinting. It does so because the array factor of the shorter elements (formed by the capacitive discontinuities) is fixed in space and dominates. It is fixed in space because there is sufficient phase length in each wrapped helix transmission line to operate as a corporate divider.

Figure 5:
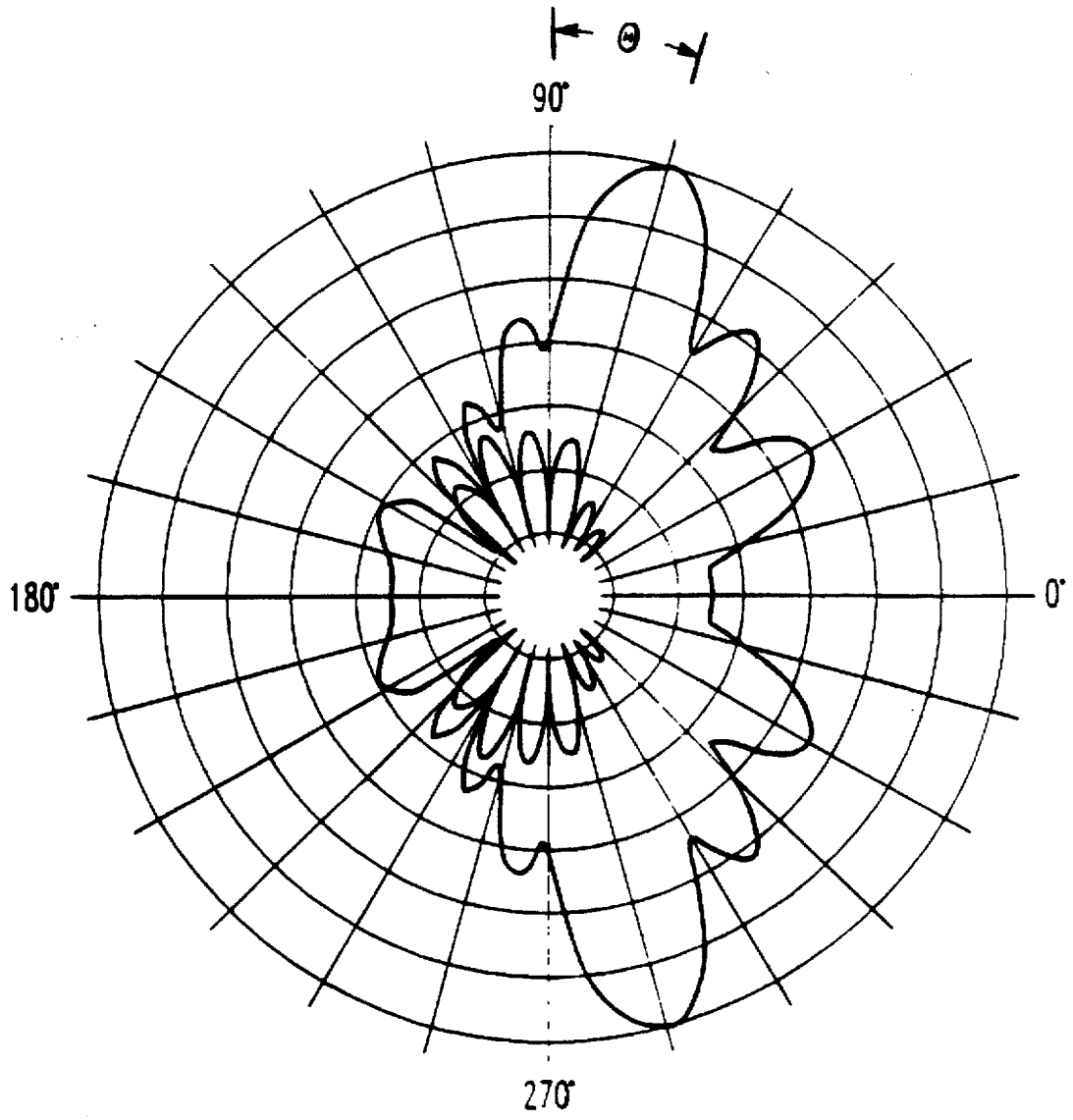
FIG. 5 illustrates a radiation pattern of the antenna of the present invention with an input at 1545 Mhz.
Figure 6:
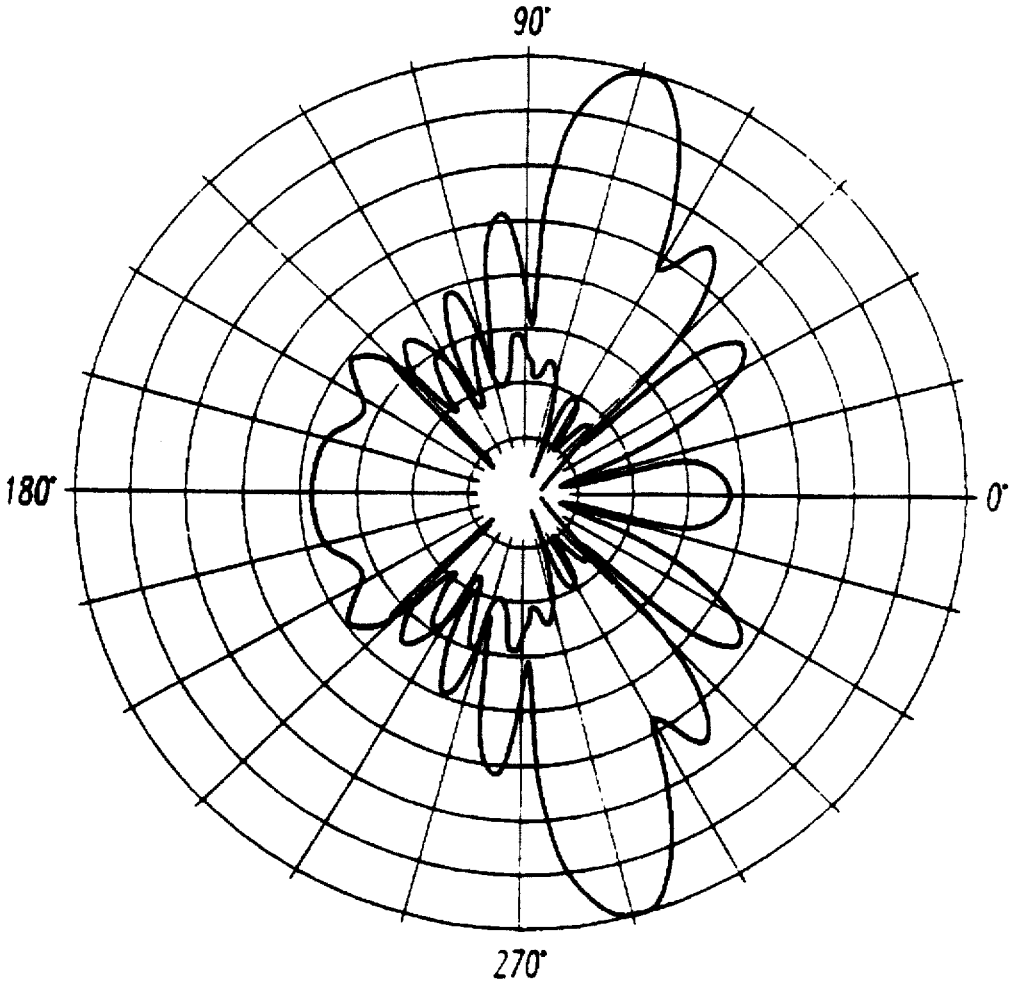
FIG. 6 illustrates a radiation pattern of the antenna of the present invention with an input at 1660 Mhz.

FIGS. 5 and 6 illustrate the beam elevation pattern of the omnidirectional helix with signal inputs at 1545 and 1660 Mhz respectively. Upon inspection, it is evident that both patterns have a maximum at about 15 degrees above the horizon and are thus nonsquinting. The outer pattern is righthand circular polarization and the inner pattern is the cross polarized left hand component.

FIGS. 7 and 8 illustrate current magnitude and phase along the length of the helix when a signal at 1545 Mhz is input to the antenna. FIG. 7 further illustrates local current peaks at elements 15, 30 and 45. Elements 1–60 are shown in the plots. It should be noted that for antenna analysis purposes, the entire antenna conductor length is viewed as a number of discrete smaller elements (lengths). In this example the thirty inch long antenna is viewed as sixty smaller elements. In this example, if the conductor is separated into 4 portions by three uniformly placed capacitive discontinuities, then the capacitors are placed at the fifteenth, thirtieth and forty-fifth elements.

Figure 9:
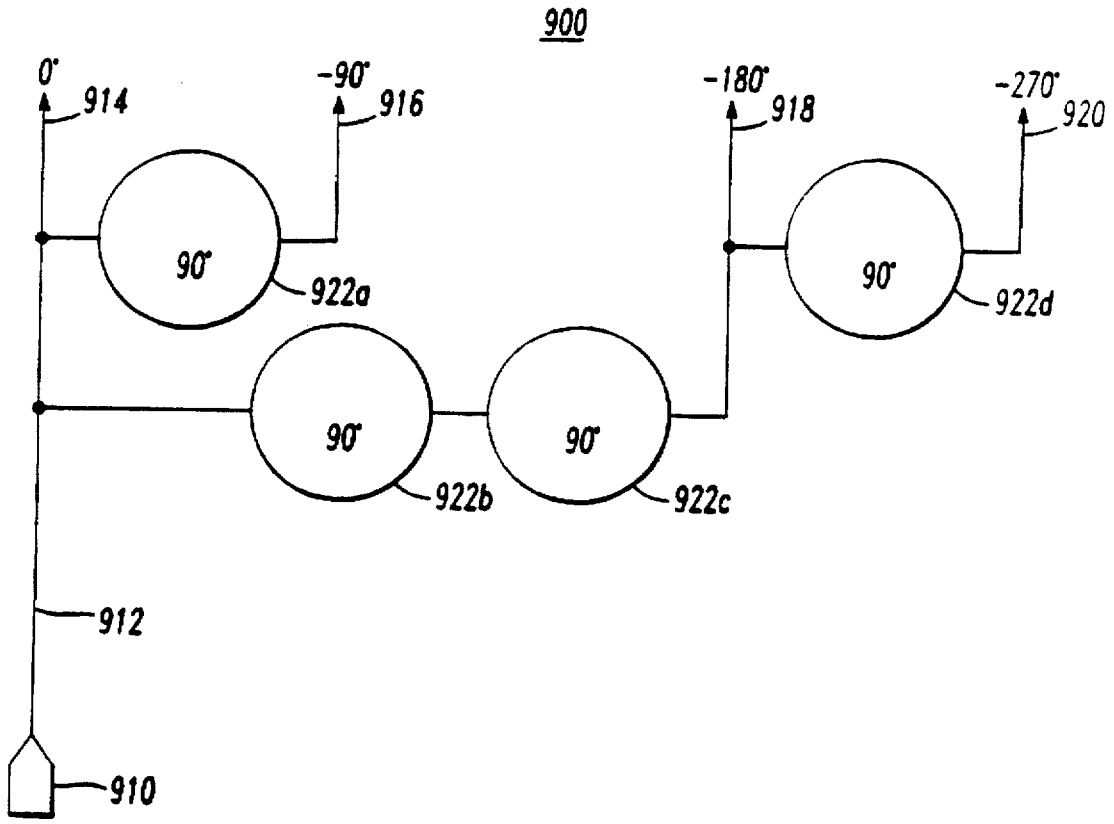
FIG. 9 illustrates an input feed phase distribution network to the quadrifilar helical antenna of the present invention.

The phase difference is introduced by connecting a single feed 910 into a phasing network 900 with a single input 912 and four outputs 914, 916, 918 and 920 as illustrated in FIG. 9. The signal path 922 from the input 910 is isolated and sent through separate transmission lines of predetermined length in order to introduce the proper phase delay in 90 degree increments before connection to each of the four respective outputs 914, 916, 918 and 920 which are in turn connected to the four conductors 414, 416, 418 and 420 of the quadrifilar helix.

It will be understood that when discussing an antenna, its properties are usually described with respect to transmission or radiation emission. However, it is well known from the reciprocity theorem that the directional pattern of a receiving antenna is identical to its directional pattern as a transmitting antenna provided that no non-linear devices are used. Thus, no distinction need be made between the transmitting and receiving functions of a given antenna in either the claims of the present invention or the general analysis of radiation characteristics. However, this does not mean that antenna current distributions are equivalent on transmission and reception.

It will be further understood that various changes in the details, steps, materials, arrangement of parts, which have been herein described and illustrated in order to explain the nature of the invention, may be made by those skilled in the art within the principle and scope of the invention as expressed in the claims.

We claim:

1. A nonsquinting end-fed, radial mode, helical antenna comprising:

a central mast;

a plurality of N conductive helices, where N is a whole number greater than 1, disposed about said mast;

each of said conductive helices having an input to accept a signal to be transmitted;

a plurality of discontinuities placed in series along each helix at a predetermined spacing, separating each helix into Z multiple sections, where Z is a whole number greater than 1;

wherein each of said discontinuities transmits a portion of energy in the antenna and reflects a portion of energy in the antenna; and wherein energy radiated from and received by said nonsquinting end-fed helical antenna is maximized at an angle θ independent of frequency, said angle θ being less than 90°.

2. The nonsquinting end-fed helical antenna as in claim 1 wherein each of said plurality of discontinuities is a capacitive discontinuity.

3. The nonsquinting end-fed helical antenna as in claim 2 wherein each of said capacitive discontinuities are substantially equal in value.

4. The nonsquinting end-fed, radial mode helical antenna as in claim 3, wherein the discontinuities each have a capacitance of 1.5 pF.

5. The nonsquinting end-fed helical antenna as in claim 2 wherein each of said capacitive discontinuities are substantially unequal in value.

6. The nonsquinting end-fed helical antenna as in claim 2 wherein each of said multiple sections are substantially equal in length.

7. The nonsquinting end-fed helical antenna as in claim 2 further comprising inductors, each inductor having two leads, connected in series to each of said helices, wherein each of said inductors has one lead connected to an end of one of said conductive helices and each of the other inductor leads connected together.

8. The nonsquinting end-fed helical antenna as in claim 2 further comprising phasing means with a single input and a plurality of N outputs, each output connected to each one of said conductive helices, and said single input connected to a signal source, for introducing a phase difference of a signal to be transmitted to said N helices.

9. The nonsquinting end-fed helical antenna as in claim 8 wherein the phase difference between the N helices is 360/N degrees.

10. The nonsquinting end-fed helical antenna as in claim 9 wherein N=4.

11. The nonsquinting end-fed, radial mode helical antenna as in claim 8, wherein the outputs of said phasing means are separated in phase by 90 degrees.

12. The nonsquinting end-fed helical antenna as in claim 2 wherein Z=2.

13. The nonsquinting end-fed helical antenna as in claim 2 wherein Z=4.

14. The nonsquinting end-fed helical antenna as in claim 2 wherein each of said capacitive discontinuities is formed by physically separating each one of said conductive helices into separate portions to form a gap between the portions and placing a dielectric across the gap connecting the portions and covering the dielectric with conductive tape.

15. The nonsquinting end-fed, radial mode helical antenna as in claim 1, wherein said capacitive discontinuities have capacitances such that an even power distribution is produced on said antenna.

16. The nonsquinting end-fed, radial mode helical antenna as in claim 1, wherein said helices have a pitch of between 4 inches and 6 inches.

17. The nonsquinting end-fed, radial mode helical antenna as in claim 1, wherein the antenna has a scan angle of between 15 degrees and 58 degrees.

* * * * *